US007278845B2

(12) United States Patent
Krause et al.

(10) Patent No.: US 7,278,845 B2
(45) Date of Patent: Oct. 9, 2007

(54) CONCRETE-BLOCK-MAKING MACHINE

(75) Inventors: Roland Krause, Burbach (DE); Ulrich Backs, Kalldof (DE)

(73) Assignee: Hess Maschinenfabrik GmbH & Co. KG, Burbach-Wahlbach (DE)

( * ) Notice: Subject to any disclaimer, the term of this patent is extended or adjusted under 35 U.S.C. 154(b) by 89 days.

(21) Appl. No.: 11/050,068

(22) Filed: Feb. 2, 2005

(65) Prior Publication Data

US 2005/0191376 A1 Sep. 1, 2005

(30) Foreign Application Priority Data

Feb. 13, 2004 (DE) ..... 10 2004 007 070

(51) Int. Cl.
*B28B 17/00* (2006.01)

(52) U.S. Cl. ..... 425/256; 425/253; 425/260; 425/447; 425/448

(58) Field of Classification Search ..... 425/164, 425/253, 256, 260, 447, 448
See application file for complete search history.

(56) References Cited

U.S. PATENT DOCUMENTS 2,598,254 A * 5/1952 Grueneberg ..... 425/361
3,822,794 A * 7/1974 Fougea ..... 249/129
4,037,730 A 7/1977 Fetzer et al.
4,063,859 A * 12/1977 Halle et al. ..... 425/139
4,207,041 A * 6/1980 Kampiziones ..... 425/62
4,421,466 A * 12/1983 Heitzman ..... 425/125
4,934,835 A * 6/1990 Albert ..... 384/43
5,687,489 A * 11/1997 Tondorf et al. ..... 33/706

FOREIGN PATENT DOCUMENTS

DE 7504296 6/1975
DE 19541281 C1 2/1997
FR 2431361 6/1978

* cited by examiner

*Primary Examiner*—Yogendra N Gupta
*Assistant Examiner*—Dimple Bodawala
(74) *Attorney, Agent, or Firm*—Townsend and Townsend and Crew LLP

(57) ABSTRACT

The invention relates to a concrete-block-making machine having a part which is displaceable via a linear drive, the linear drive comprising a drive unit and a linear guide for guide rollers, the drive unit comprising at least one linear motor and the linear guide comprising at least one guide rod for the guide rollers, the at least one guide rod and the guide rollers movable relative thereto being hardened, and guide rollers and guide rod being arranged with slight play relative to one another.

10 Claims, 2 Drawing Sheets

CONCRETE-BLOCK-MAKING MACHINE

FIELD OF THE INVENTION

The invention relates to a machine for producing concrete blocks for constructional purposes.

BACKGROUND OF THE INVENTION

For the production of concrete blocks, concrete-block-making machines are used in which a mould is filled with concrete mortar by means of a filling carriage. In this case, the filling carriage with the concrete mortar is moved horizontally right across the mould, so that the concrete mortar can fall into the mould. The filling carriage, open at the top and bottom and located below a silo, is filled in the process and moved by means of a linear drive across a table plate into a position above the mould located on a production base. In this case, the filling carriage is guided by a horizontal guide. In the process, considerable contamination occurs, which is caused by cement dust released in particular during the compacting operation and which, due to deposits, impairs the linear drive for the filling carriage and in particular the linear guide. This is countered by the filling carriage being moved with considerable play along rails by means of wheels or rollers. However, this does not permit high positioning accuracy and repetitive accuracy, which are important for a uniform block quality.

SUMMARY OF THE INVENTION

An object of the invention is to provide a concrete-block-making machine wherein the block quality is practically not impaired by the dusty environment and corresponding play between moving part and guide.

Owing to the fact that according to the invention a linear guide is used which comprises at least one guide rod for guide rollers of the part to be moved, in particular of the filling carriage, the at least one guide rod and the guide rollers movably guided relative thereto being hardened, the guide becomes insensitive to dust despite the smallest possible play, since this achieves the effect that dust deposited on the at least one guide rod is rolled and thereby flattened between the guide rod and the guide rollers by the movement of the guide rollers along the guide rod. In this way, the linear guide cleans itself automatically, the hardening of the parts guided in engagement with one another preventing damage to said parts due to the dust. This enables a linear motor to be used as drive unit, since a small air gap between primary part and secondary part, as is required in a linear motor, can in this case be maintained with sufficient accuracy. The linear motor in turn leads to high positioning accuracy of the part to be moved, is highly dynamic and permits very high repetitive accuracy of its sequence of movement, as a result of which, in particular in the case of a filling carriage as moving part, high repetitive accuracy of the filling operation of the mould of a concrete-block-making machine and thus a correspondingly uniform block quality are obtained.

Further objects, advantages and embodiments of the invention can be gathered from the following description.

BRIEF DESCRIPTION OF THE DRAWINGS

The invention will now be explained in more detail below with reference to an exemplary embodiment shown in the attached figures.

DETAILED DESCRIPTION OF THE PREFERRED EMBODIMENT

Figure 1:
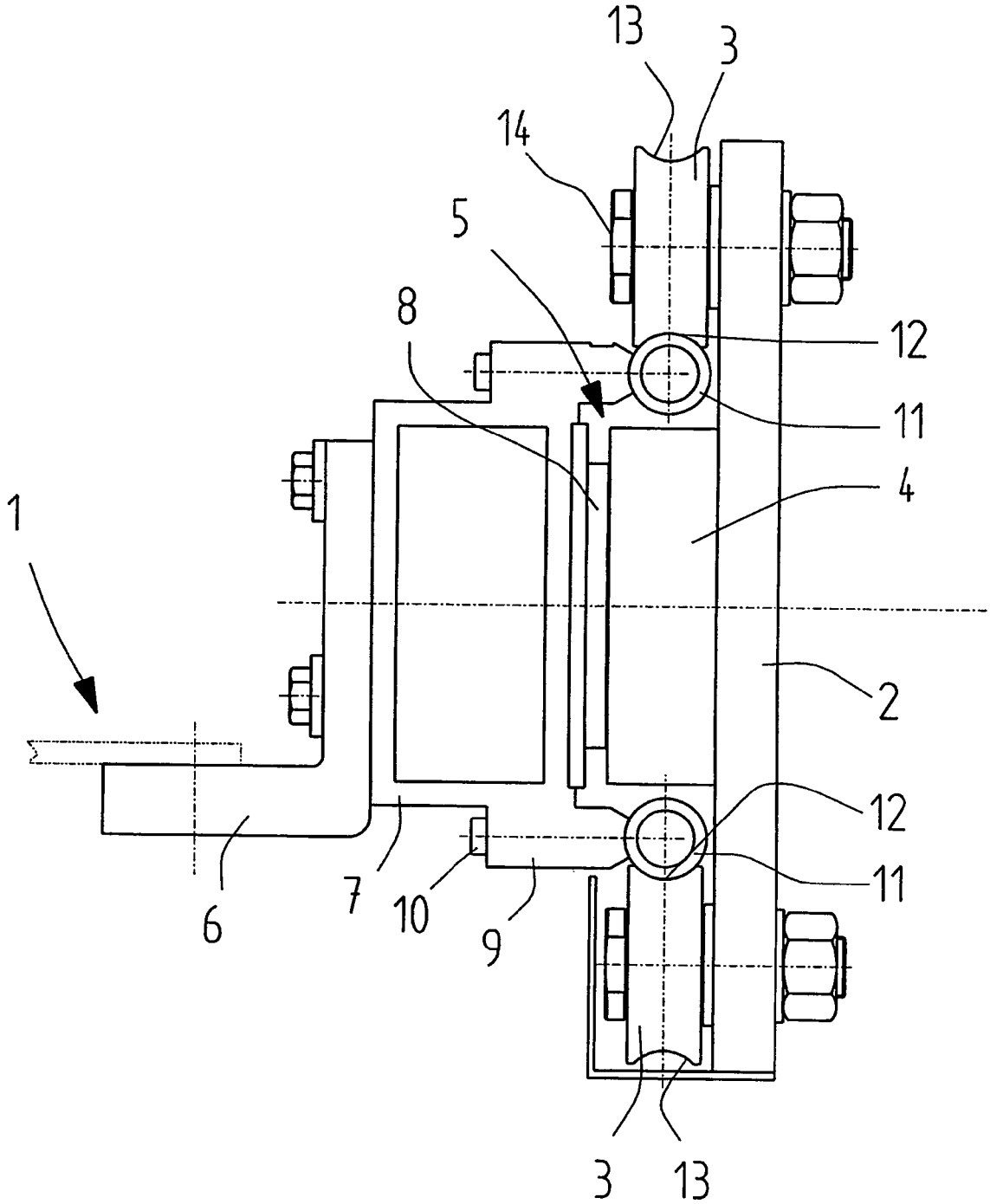
FIG. 1 shows a detail of an embodiment of a linear drive with linear guidance of a filling carriage of a concrete-block-making machine.

FIG. 1 shows a detail of a linear drive on one side of a filling carriage 1 of a concrete-block-making machine, although such a linear drive is provided at a filling carriage on each side thereof. The linear drive comprises a fixed cheek 2 having a plurality of top and bottom guide rollers 3. A fixed primary part 4 of a linear motor 5 (coil arrangement) is arranged on the cheek 2 between the top and bottom guide rollers 3.

At the filling carriage 1 is fastened, for example via an angle 6, a support section 7, for instance a box section in particular made of an aluminium alloy, which carries the permanently magnetic secondary part 8 of the linear motor 5 and has a length which corresponds at least to the amount of travel of the filling carriage 1 plus the length of the cheek 2. There is a slight air gap between the primary and secondary parts 4 and 8, respectively, of the linear motor 5.

Two parallel guide rods 11 arranged at a distance apart one above the other are fastened to the box section 7 by means of legs 9 and screws 10 accommodated by the latter, these guide rods 11 extending in the longitudinal direction of the box section 7 and engaging with the top and bottom guide rollers 3 by means of their respective engagement surfaces 12 facing the guide rollers 3. In this case, the guide rollers 3 have engagement surfaces 13 complementary to the profile of the guide rods 11, so that there is only very slight play between the engagement surfaces 12, 13.

The guide rods 11 preferably have a convex engagement surface 12 of preferably circular cross section and are circular-cylindrical in the exemplary embodiment shown, but they could also have an oval cross section or be convex only in the region of the engagement surface 12 and otherwise rectangular in cross section. The engagement surfaces 13 of the guide rollers 3 are then correspondingly concave.

Depending on the desired stability, the support section 7, which as box section is sufficiently rigid and nonetheless correspondingly light, instead of being designed in the form of a box section, may also be designed in the form of an elongated plate set on end, in which case the guide rods 11 may be attached above and below said plate. The edges of the plate itself may then also be designed as convex engagement surfaces, so that the plate forms a guide rod having two engagement surfaces.

The guide rollers 3 are expediently mounted on stub axles 14 fastened to the cheek 2.

At least the engagement surfaces 12 of the guide rods 11 and the engagement surfaces 13 of the guide rollers 3 of the top engagement pair are expediently made of steel and are hardened, so that, on account of the weight of the component to be moved, here the filling carriage 1, dust on the engagement surface 12 at the top—the engagement surface 12 of the top guide rod 11—is rolled when the guide rollers 3 roll over it as a result of the moving of the component and this ultimately causes said dust to flake off without the guide rod 11 and the guide rollers 3, which are arranged with the smallest possible play relative to one another, being impaired as a result.

Figure 2:
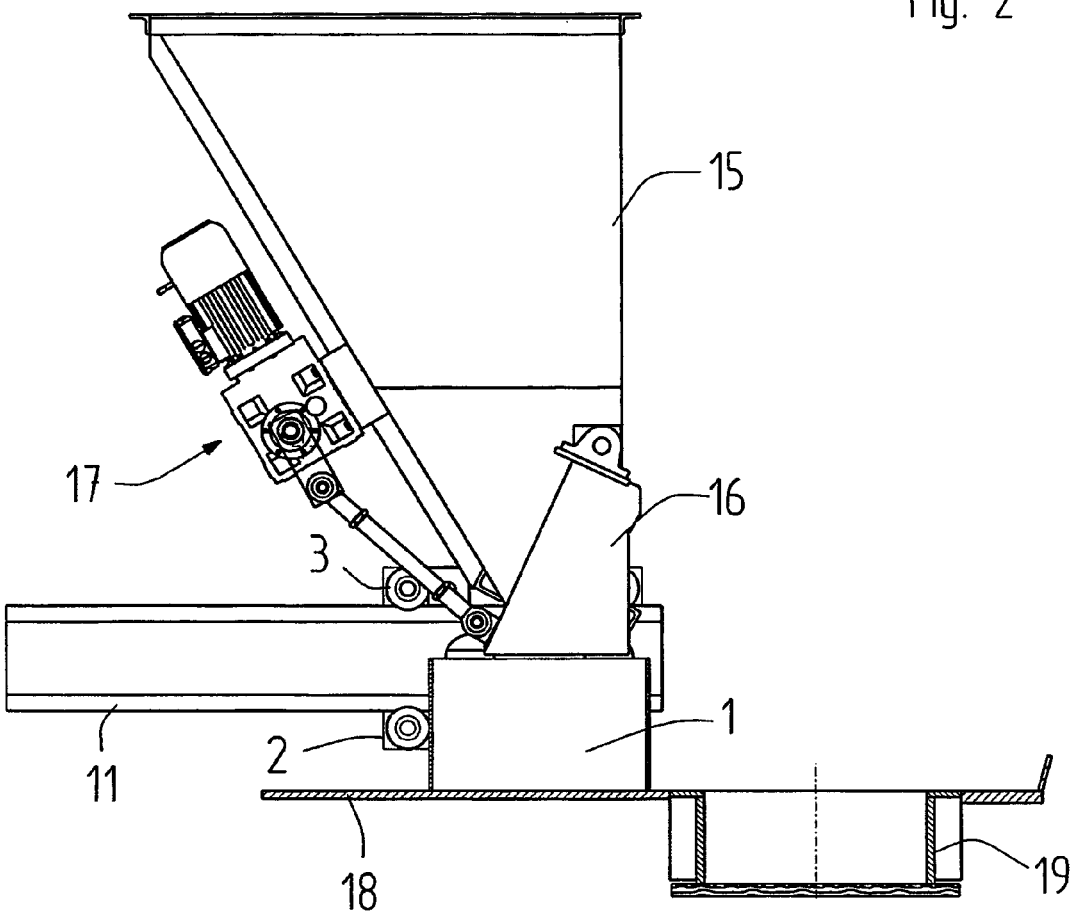
FIG. 2 shows a filling carriage located in the receiving position for a mould of a concrete-block-making machine having a linear drive according to FIG. 1.
Figure 3:
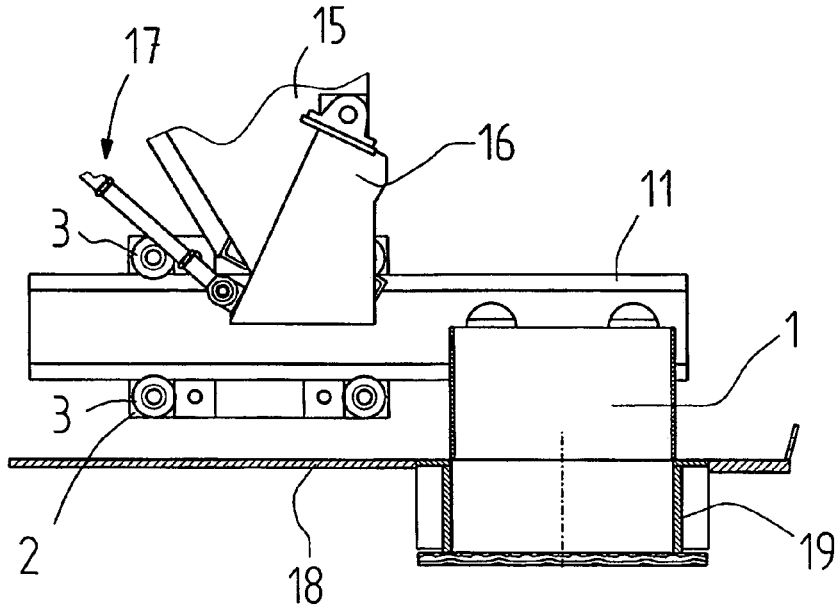
FIG. 3 shows a detail of FIG. 2 with the filling carriage in its filling end position.

The filling apparatus, shown in FIGS. 2, 3, for a concrete-block-making machine comprises one or possibly more silos 15 having a funnel-shaped outlet and a flap 16 which is linked to the silo 15 and is movable between an open and a closed position by means of a drive 17 comprising a linkage acting on the flap 16. Located below the silo 15 in the illustration of FIG. 2 in the filling position is the filling carriage 1, which is open at the top and bottom. The filling carriage 1 can be moved by means of the linear motor 5 across a table plate 18 between the filling position of FIG. 2 and a position shown in FIG. 3 in which it is located above a mould 19 for concrete blocks, which is located on a production base.

The guide rods 11 may also be arranged in a fixed position, while the guide rollers 3 are located on the movable component, for instance on the filling carriage 1.

While the invention has been shown and describes with reference to a preferred embodiment, it should be apparent to one of ordinary skill in the art that many changes and modifications may be made without departing from the spirit and scope of the invention as defined in the claims.

What is claimed is:

1. A concrete-block-making machine comprising:

a carriage which is displaceable horizontally via a linear drive;

the linear drive comprising a drive unit and a linear guide for guide rollers;

wherein the drive unit comprises at least one linear motor having a primary part and a secondary part; and the linear guide comprises two parallel guide rods for the guide rollers, wherein said guide rods are arranged vertically at a distance apart one above the other, the guide rods and the guide rollers movable relative thereto being hardened and having engagement surfaces complementary to each other, wherein the guide rollers and guide rods are arranged with the smallest possible play relative to one another such that dust deposited on the guide rods is rolled and flattened by the movement of the guide rollers along the guide rods, thereby causing the dust to flake off and automatically cleaning the linear guide.

2. The machine according to claim 1, wherein the guide rods have convex engagement surfaces and the guide rollers have complementary concave engagement surfaces.

3. The machine according to claim 2, wherein the engagement surfaces are in the shape of a sector of a circle in cross section.

4. The machine according to claim 1, wherein at least two parallel guide rods are provided.

5. The machine according to claim 4, wherein the guide rods are arranged on a support section.

6. The machine according to claim 5, wherein the support section is a box section.

7. The machine according to claim 4, wherein the primary part of the linear motor is arranged in the region between the guide rods.

8. The machine according to claim 7, wherein the carriage carries the secondary part-of the linear motor.

9. The machine according to claim 1, wherein the part is a filling carriage for a mould of the concrete-block-making machine, a respective linear drive being arranged on opposite sides of the filling carriage.

10. The machine according to claim 9, wherein the guide rods are arranged on the filling carriage.

* * * * *